United States Patent [19]

Suzuki

[11] Patent Number: 4,620,570

[45] Date of Patent: Nov. 4, 1986

[54] METHOD AND APPARATUS FOR DISPOSAL OF WEFT YARN IN A JET LOOM

[75] Inventor: Hajime Suzuki, Anjo, Japan

[73] Assignee: Kabushiki Kaisha Toyoda Jidoshokki Seisakusho, Kariya, Japan

[21] Appl. No.: 834,154

[22] Filed: Feb. 27, 1986

Related U.S. Application Data

[63] Continuation of Ser. No. 491,936, May 5, 1983.

[30] Foreign Application Priority Data

| | | | |
|---|---|---|---|
| May 11, 1982 | [JP] | Japan | 57-77436 |
| Jun. 5, 1982 | [JP] | Japan | 57-95614 |
| Jun. 9, 1982 | [JP] | Japan | 57-97851 |
| Jun. 9, 1982 | [JP] | Japan | 57-97852 |

[51] Int. Cl.[4] ..... D03D 47/30

[52] U.S. Cl. ..... 139/435; 139/116; 139/1 E

[58] Field of Search ..... 139/1 R, 1 E, 435, 302, 139/116

[56] References Cited

U.S. PATENT DOCUMENTS

| | | | |
|---|---|---|---|
| 3,805,850 | 4/1974 | Van Duynhoven et al. | 139/1 E |
| 4,185,667 | 1/1980 | Kendrick | 139/302 |
| 4,448,223 | 5/1984 | Deborde et al. | 139/435 |
| 4,503,891 | 3/1985 | Novak et al. | 139/435 |

FOREIGN PATENT DOCUMENTS

| | | | |
|---|---|---|---|
| 2935507 | 3/1981 | Fed. Rep. of Germany | 139/1 E |
| 2090294 | 7/1982 | United Kingdom | 139/435 |

*Primary Examiner*—Henry S. Jaudon

*Attorney, Agent, or Firm*—Brooks Haidt Haffner & Delahunty

[57] ABSTRACT

In a jet loom embodying the present invention, in general, measured lengths of the weft yarn are inserted by fluid actuation into the shed delimited between the upper and lower warp yarns. When stop signals for the loom are sensed, the weft yarn about to be inserted into the shed is deflected under suction from its normal course and thus inhibited from entering the warp shed until the time of complete stop of the operation of the loom, which is braked. After the termination of braking, the moving components of the loom are operated in reverse and brought in this manner to a predetermined angular position of one weaving cycle. With the loom resting in this position, the lastly inserted weft yarn is disposed of.

Suction of the weft yarn is performed by a suction pipe having a suction opening disposed near the usual weft route. This suction pipe is mounted for example intermediate the jet nozzle and the selvage towards the jet nozzle, intermediate the weft yarn supply unit and the jet nozzle or in the neighborhood of the temple.

According to preferred embodiments, a structure is provided for guiding the weft yarn toward the suction opening of said suction pipe.

13 Claims, 50 Drawing Figures

METHOD AND APPARATUS FOR DISPOSAL OF WEFT YARN IN A JET LOOM

This application is a continuation of application Ser. No. 491,936, filed May 5, 1983.

BACKGROUND OF THE INVENTION

This invention relates to a method and apparatus for disposal of weft yarn in a shuttleless loom such as an air jet loom or water jet loom.

Towards realizing higher speeds in the weaving operation, air or water jet looms are employed wherein measured lengths of the weft yarn are inserted into the shed defined between upper and lower warp yarns. In these high-speed looms, the effect of interruptions of loom operation on the productivity or operating efficiency is more pronounced than in conventional looms. Hence it is preferred that the time interval of these interruptions or machine dwell time be as short as possible. On the other hand, jet looms are more susceptible to weft inserting failure than in shuttle looms because the weft yarn is carried through the shed by air or water and thus without resorting to shuttles. Hence, there may occur a supply failure, that is, the weft not being supplied from the supply jet nozzle, or a transfer failure, that is, the weft yarn not reaching the selvage yarn opposite to the jet nozzle.

In a jet loom operating at an elevated speed, the operational timing is so selected that although the drive system of the loom is deactivated upon detection of a weft inserting failure in order to avoid possible troubles due to excessive deceleration, the movable parts of the loom are halted only after about one cycle of inertial operation subsequent to the detection of the weft inserting failure. The result is that, in cases where the jet loom is stopped responsive to the inserting failure signals, the weaving cycle next to the cycle during which the inserting failure is occurred is executed before the machine is actually at a standstill. Hence, not only does the waft yarn fail to reach the opposite selvage, but also the next following weft yarn needs to be removed through the reversal of the loom operation. However, it is extremely difficult to remove the weft yarn inserted directly after the occurrence of the inserting error because it is already beated up as the other weft yarns and thus held firmly in the cloth. In addition, since the jet nozzle side end of the weft yarn failing to reach the opposite selvage is cut short, it is extremely difficult to hold this yarn end. The result is that the weft yarn failing to reach the opposite selvage can be removed only by an extremely difficult and troublesome operation. In addition, in order to carry out the correction of the inserting error and to restart the loom, it is necessary to operate the various movable parts of the loom for reversing the loom operation in accordance with a complicated operational procedure. This requires considerable skill.

On the other hand, in cases where the warp yarns including the selvage yarns are broken during weaving, or where the main switch of the loom is turned off through human intervention, the loom is halted after an inertial operation continuing for about one weaving cycle, for the reason discussed above. The weft yarn inserted during this inertial operation also has to be removed, if it is desired to obtain a woven cloth free of the weaving bar or the like defects. However, it is extremely difficult to remove the weft yarn once inserted during this inertial operation, as discussed above in connection with weft inserting failure.

Accordingly, there was a need for the method and apparatus for disposal of weft yarn in case of occurrence of weft inserting failure or warp breakage in a jet loom, by means of which the jet loom halted through weft inserting failure, warp breakage or human intervention can be readied for restarting easily and without requiring operational skill.

SUMMARY OF THE INVENTION

In a jet loom embodying the present invention, in general, measured lengths of the weft yarn are inserted by fluid actuation of a jet nozzle into the shed delimited between the upper and lower warp yarns, and are normally cut from the weft supply by a conventional weft yarn cutter mounted in fixed position adjacent to the selvage nearest the jet nozzle. When stop signals for the loom are sensed, the weft yarn about to enter the shed is deflected by suction from its usual course and thus inhibited from proceeding into the warp shed until the time of complete stop of the loom, which is braked. After termination of braking, the loom is reoperated in reverse and brought in this manner to a predetermined angular position of one weaving cycle. With the loom resting in this position, the lastly inserted weft yarn is disposed of.

When the stop signal is the inserting failure signal, it is preferred to reverse the loom operation for setting the loom to a shed-forming position allowing the extraction of the weft yarn inserted at the time of delivery of weft insertion failure signal, and the extraction of the weft yarn with the loom resting stationary.

When the stop signal is the warp yarn breakage signal, it is preferred to reverse the loom operation for setting the loom to a shed-closing position of the warp yarns that existed immediately before the occurrence of the insertion inhibit state, and to join or piece the yarn ends together, after which the loom is restarted. Alternatively, the yarn ends are first joined together, and the loom operation is then reversed for setting the loom to a position that existed immediately before occurrence of the insertion inhibit state, the loom being restarted from this position.

Suction of the weft yarns is performed by a suction nozzle having a suction opening disposed in the vicinity of the usual weft route. This suction nozzle may be arranged for example between the jet nozzle and the selvage yarn disposed towards the jet nozzle, between the weft supply unit and the jet nozzle, or in the neighborhood of the temple.

According to preferred embodiments, means are provided for guiding the weft yarn towards the suction opening of the aforementioned suction nozzle.

BRIEF DESCRIPTION OF THE DRAWINGS

This invention will become more readily apparent from the following description of preferred embodiments thereof shown by way of an example only, in the accompanying drawings, wherein.

DESCRIPTION OF THE PREFERRED EMBODIMENTS

Figure 1:
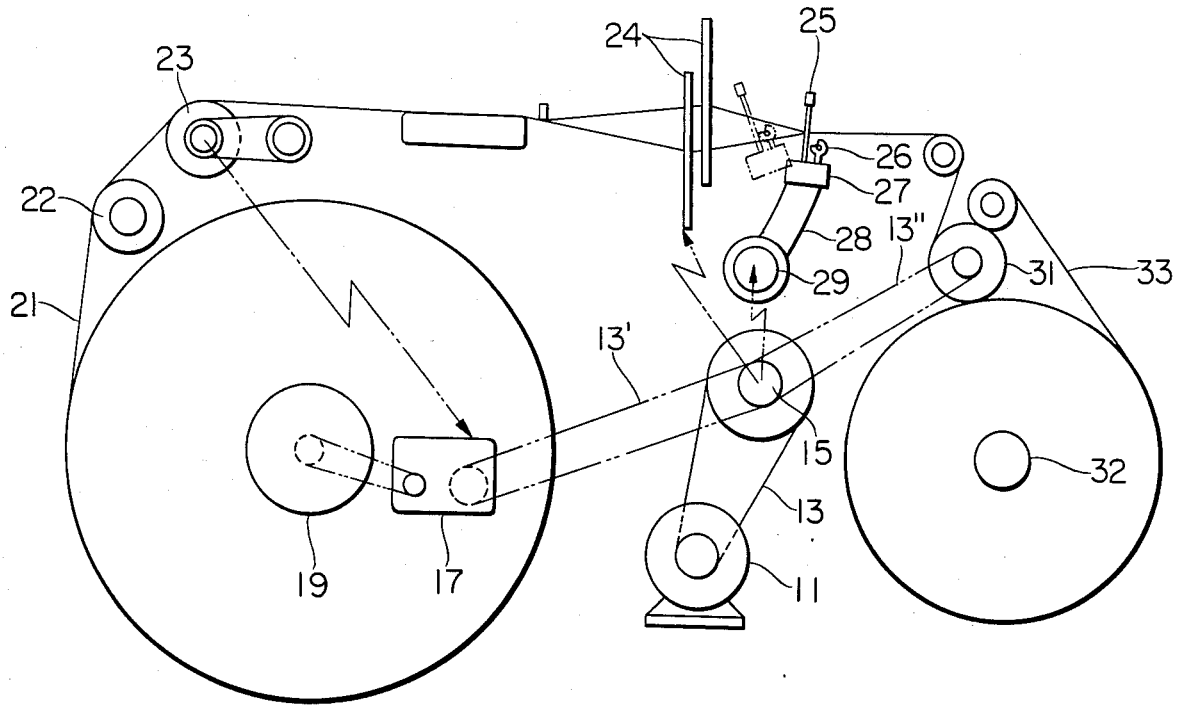
FIG. 1 is a side elevation showing a driving system for an air jet loom, to which the present invention is applied.

The present invention will be described in more detail by referring to the accompanying drawings, wherein FIG. 1 shows in schematic side elevation the driving system of an air jet loom according to the present invention. Motive power is transmitted as conventionally from a driving motor 11 to a crankshaft 15 through a motion transmission system such as V belt 13. By the operation of the crankshaft 15, a yarn beam 19 is driven through a V-belt 13' and a speed change unit 17 for reeling a warp yarn 21 from the beam 19, while a take-up roller 32 is friction driven through another V-belt 13'' and a surface roller 31 for winding a woven fabric 33 on the roller 32. The speed change ratio of the unit 17 may be adjusted as a function of displacement of the tension roller 23 for maintaining a constant tension of the warp yarn reeled out through a back roller 22. In addition, by the operation of the crankshaft 15, a large number of heald frames 24 are moved alternately up and down to permit required ones of the warp yarns to form the shed, while a weft guide 26 and a reed 25 attached to a slay 27 carried by a rocking shaft 29 through a slay sword 28 are reciprocated between solid line and chain-dotted line positions for beating the inserted weft yarn. The arrangement described above is similar to that of the conventional air jet loom.

Figure 2:
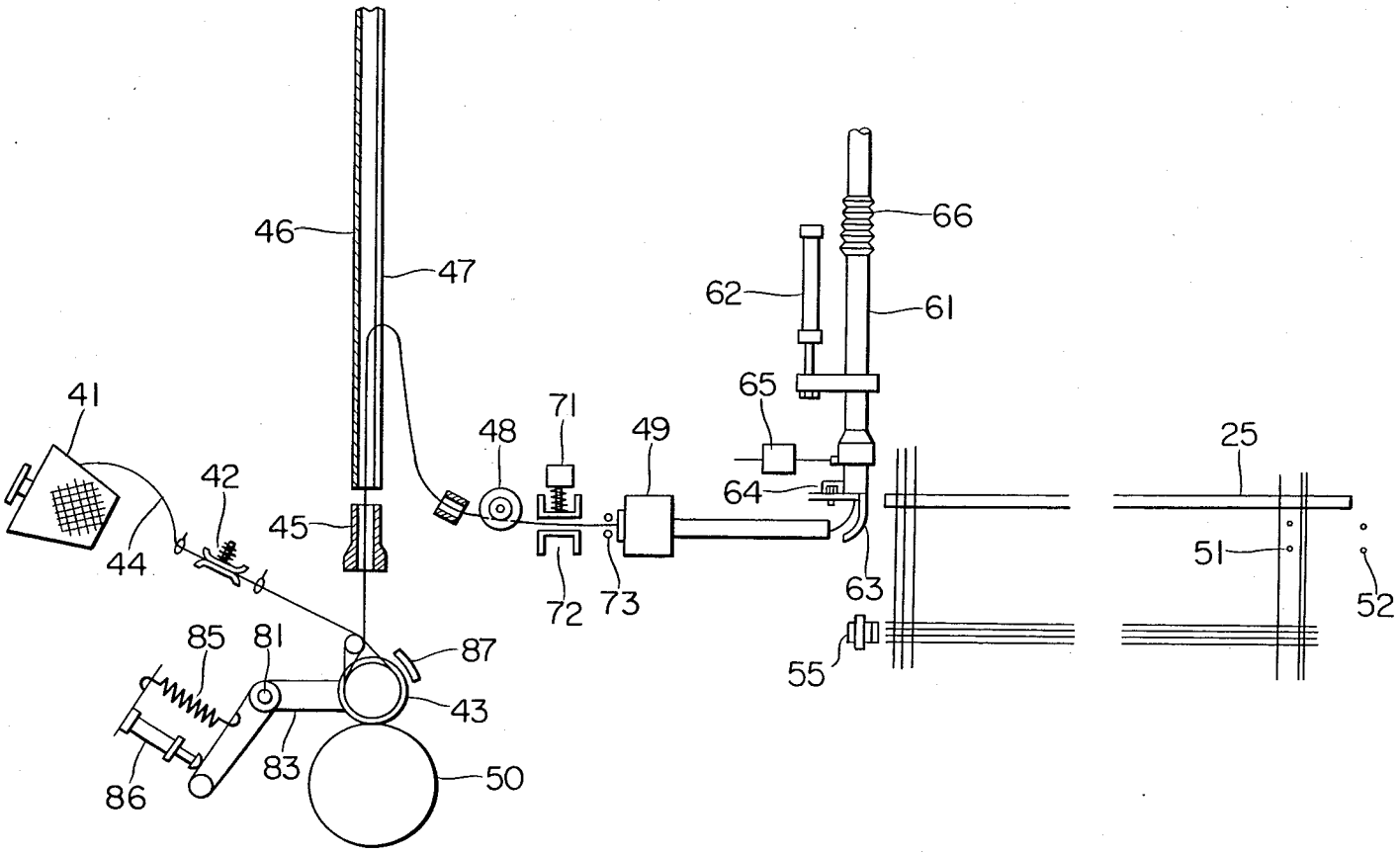
FIG. 2 is a schematic plan view showing the weft yarn disposal device for the jet loom shown in FIG. 1 that may be used in practicing the inventive method.
Figure 3:
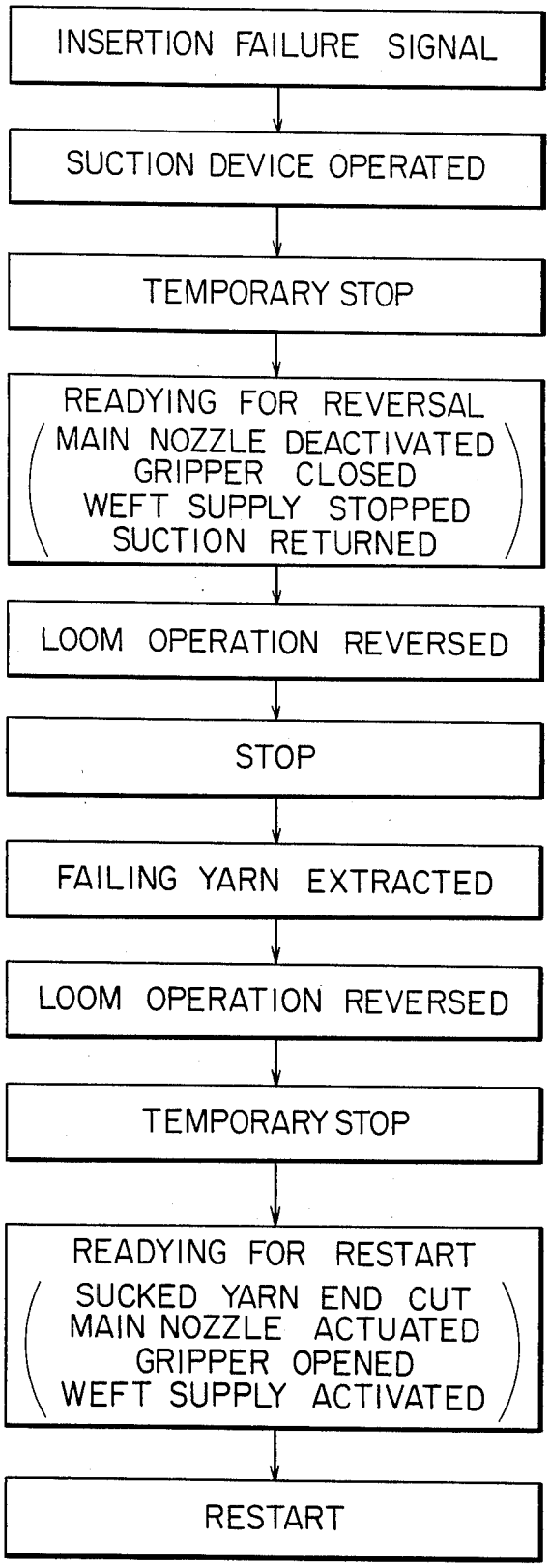
FIG. 3 is a flowchart for the first embodiment of the method according to the present invention.

The weft yarn inserting system is now described in more detail by referring to FIG. 2. A weft yarn 44 is reeled out from a cheese 41 through a tensor 42 by a feed roller 43 and stored in a pool pipe 46 through an air nozzle 45. A weft yarn length measuring drum 50 is operatively connected to the crankshaft 15 (FIG. 1) and maintained in frictional driving contact with the feed roller 43 so that predetermined lengths of the weft yarn 44 are measured out by the feed roller 43 through rotation of the crank shaft 15 (FIG. 1) and supplied to the air nozzle 45 for each weaving cycle. The pool pipe 46 has an axial slot 47 on one side so that the weft yarn 44 stored in the pipe 46 may be taken out through the slit 47. It should be noted that a weft yarn length measurement unit, wherein the weft yarn is wound about the periphery of a weft yarn length measuring drum and reeled out therefrom in a controlled manner as disclosed in the Japanese Laid-Open Patent Specifications Nos. 16946/1982 and 58028/1981, may be used in place of the feed roller-pool type combination described in the foregoing.

A weft yarn gripper 48 is provided between the pool pipe 46 and a main air jet nozzle 49 for controlling the supply of the weft yarn 44 from the pool pipe 46 to the main air jet nozzle 49. A blast of compressed air is ejected from the main air jet nozzle 49 in timed relation with rotation of the crankshaft 15 (FIG. 1) while another blast of compressed air is ejected from each of auxiliary air jet nozzles, not shown, provided adjacent to the reed 25. The weft yarn 44 may thus be impelled into the shed defined between upper and lower warp yarns 21 and beaten by the reed 25 up to the previously inserted yarn.

The arrangement described above is also similar to that of the conventional air jet loom. In addition thereto, according to preferred embodiments of the present invention, sensors 51, 52 are provided in the vicinity of the selvedge yarn remote from the main air jet nozzle 49 for sensing whether or not the weft yarn 44 has been inserted positively. These sensors are operated photoelectrically, mechanically or hydraulically for sensing that the weft yarn is supplied positively from the main nozzle 49, as described for example in the Japanese Patent Specification No. 21475/1979.

The device for weft yarn insertion inhibit device operating to dispose of the weft yarn according to the present invention is described below in more detail. An ejector type suction nozzle 61 as known per se and adapted for generating a force of suction through compressed air is provided between the main nozzle 49 and the selvage yarn. The nozzle 61 is operatively connected to a suitable reciprocating unit 62 such as an air cylinder or electromagnetic solenoid so that, by operation of the unit 62, the tip of the suction nozzle 61 is movable between a position adjacent to the normal route of the weft yarn propelled through the main nozzle 49 and a position spaced apart from the weft yarn route.

In the present embodiment, the force of suction is generated by the ejecting operation of the compressed air. However, this is not limitative of the present invention and, for example, use may be made of a suction nozzle in which the force of suction is developed from a negative pressure source suitably connected to the nozzle.

An arcuate guide plate 63 is secured to the tip of the suction nozzle 61 with the concave side directed towards the main nozzle 49 in such a manner that the guide plate 63 intersects or deviates away from the weft yarn route when the suction nozzle 61 is advanced towards or retracted from said route, respectively. A bellows type expansion joint 66 is connected to the rear end of the suction nozzle 61 to permit smooth movement of the suction nozzle 61. It should be noted that the suction nozzle 61 and the guide plate 63 formed integrally therewith may also be rotated vertically instead of being movable in the fore and aft direction of the loom as in the present embodiment. In the drawings, the numeral 64 designates a weft yarn cutter mounted near the tip of the main nozzle 49 and the numeral 65 a valve for controlling air flow ejection into the inside of the suction nozzle 61.

There is also provided an auxiliary gripper 72 intermediate the main air jet nozzle 49 and the gripper 48 so as to be opened or closed by the operation of an electromagnetic solenoid 71 or a pneumatic cylinder, not shown. The numeral 73 designates a feeler operated photoelectrically, mechanically or hydraulically.

The aforementioned feed roller 43 is rotatably carried by the end of a hanger-shaped arm 83 carried in turn rotatably about a pin 81. A spring 85 is mounted between some fixed portion of the loom and the end part of the arm 83 opposite to the feed roller 43 and acts on the arm 83 so that the arm 83 abuts at all times on the foremost part of an armature of an electromagnetic solenoid or on a piston of a pneumatic cylinder 86. Hence, by the operation of the spring 85 and the pneumatic cylinder 86, the feed roller 43 may be biased to a first position, in which it is pressed against the drum 50 and thereby driven through friction, or a second position in which it is spaced apart from the drum 50 and hence is not driven by the drum. The numeral 87 designates a brake shoe adapted to brake the feed roller 43 through frictional contact therewith when the roller 43 is moved away from the drum 50.

Reference is had to FIGS. 3, 4A through 4G and FIGS. 5A through 5C for illustrating the method for weft yarn disposal making use of the device shown in FIG. 2. It should be noted that the guide plate 63 may be straight and hence shown in FIGS. 5A through G in this state, although the plate is shown to be arcuate in FIG. 2.

Figure 4A:
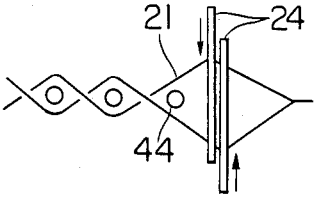
FIGS. 4A through 4G are schematic side views showing the various positions of heald frames and the shed in connection with the first embodiment of the invention.
Figure 5A:
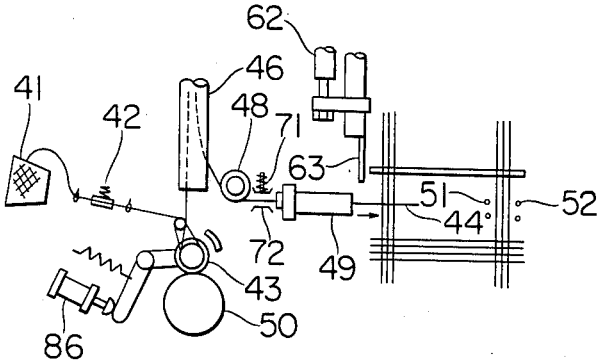
FIGS. 5A through 5G are schematic views of the weft inserting device corresponding to FIGS. 4A through 4G, respectively.
Figure 5B:
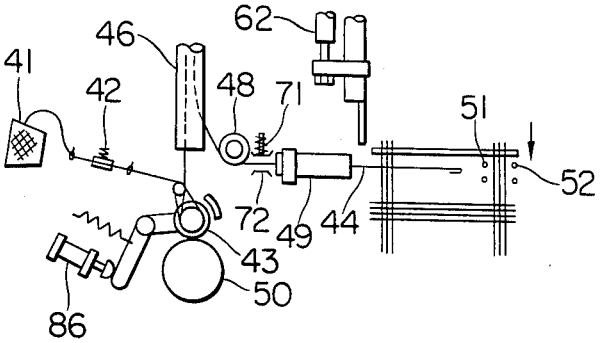

The heald frames shown in FIG. 4A are brought to a shed forming position and the weft yarn 44 is inserted into the shed defined between the upper and lower warp yarns 21. As shown in FIG. 5A, the weft yarn 44 is reeled out from the cheese 41 through the tensor 42, and a length of the yarn is measured out in each weaving cycle by a feed roller 43 kept in frictional driving contact with the measuring drum 50 rotating with rotation of the crankshaft 15 (FIG. 1) making one complete revolution per each weaving cycle. The measured out length of the yarn is stored in the pool pipe 46 through the operation of the air nozzle 45 (FIG. 2). The operation of the yarn gripper 48 provided intermediate the pool pipe 46 and the main air jet nozzle 49 and the main air jet nozzle are controlled in timed relation with the rotation of the crankshaft 15 (FIG. 1) so that the length of the yarn 44 stored in the pool hopper 46 is impelled into the shed defined between the upper and lower warp yarns 21, and is normally cut from the weft supply by the cutter 55.

The sensors 51, 52 mounted in the vicinity of the selvage remote from the main air jet nozzle 49 make a check of the weft yarn position when the warp yarns 21 are substantially in the shed closing position corresponding to the crank angle of 250° to 300°. When the failure in weft insertion has occurred, that is, when the weft yarn inserted into the shed has failed by some reason to get to the selvage yarn on the side of the woven cloth opposite to the main nozzle 49, failure signals are issued from the sensors 51, 52 indicating that failure in weft insertion has occurred. Upon reception of these failure signals, the motor 11 (FIG. 1) driving the various movable parts of the loom is stopped and enters into an inertial operation.

Figure 4B:
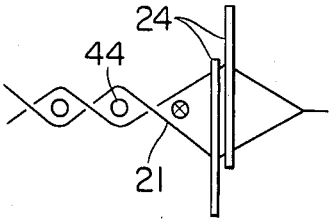
Figure 4C:
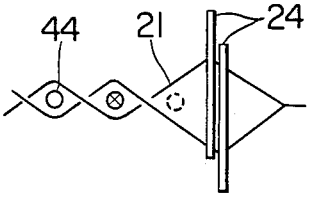
Figure 5C:
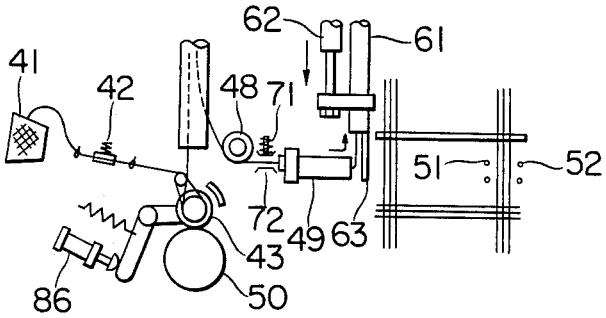

In addition, the piston of the reciprocating device 62 is advanced responsive to these failure signals as shown in FIG. 5C so that the guide plate 63 fastened to the tip of the suction nozzle 61 is intruded into the weft yarn route. In this manner, the weft yarn impelled from the main air jet nozzle 40 after the occurrence of the failure in weft yarn insertion is guided by the guide plate 63 and sucked into the suction nozzle 61. Thus, the weft yarn is inhibited from intruding into the warp shed. In FIGS. 4B to 4F, the weft yarn 44 is shown with circles and the weft yarn which has failed to get to the opposite selvage is indicated by cross marks surrounded by circles. In FIGS. 4C ro 4F, the weft yarn 44 inhibited from intruding into he warp shed hsed is indicated with dotted-line circles.

Figure 4D:
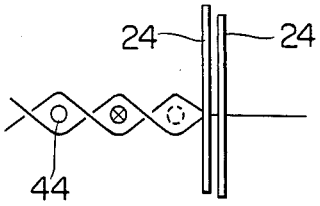

The various movable parts of the loom are moved by inertial operation and stopped after approximately one weaving cycle at the shed closing position of FIG. 4D corresponding to the crank angle of approximately 300°.

Figure 5D:
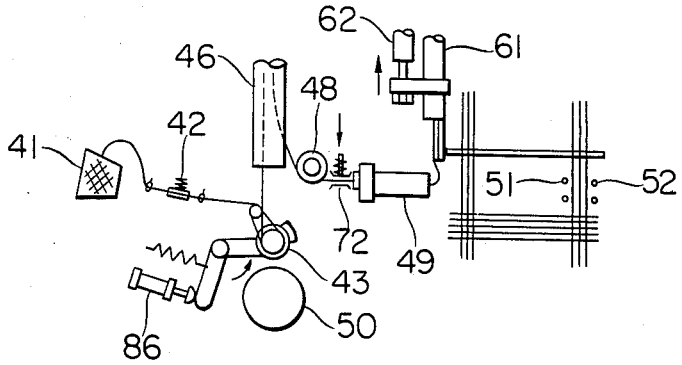
Figure 5E:
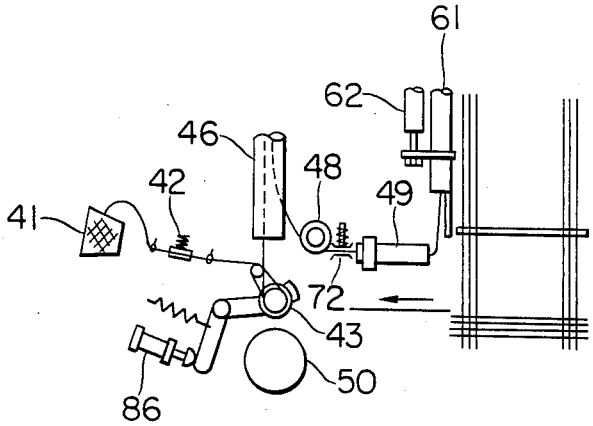

The device is then readied for reversing operation. The main air jet nozzle 49 is rendered inoperative, the gripper 48 is closed and the auxiliary gripper 72 is closed through the operation of the magnetic solenoid 71. The pneumatic cylinder 86 is actuated for separating the feed drum 50 from the feed roller 43 and deactivating the weft supply unit. The piston of the reciprocating unit 62 is retracted for deviating the guide plate 63 attached to the suction nozzle 61 from the weft yarn route (FIG. 5D). The crankshaft 15 is reversed through approximately 480° by directly reversing the driving electric motor 11 (FIG. 1) or by actuating an auxiliary motor, not shown, provided in addition to the driving motor. In this manner, the warp yarns 21 are brought to a shed forming position shown in FIG. 4E (corresponding to the crank angle of approximately 180°).

Figure 4E:
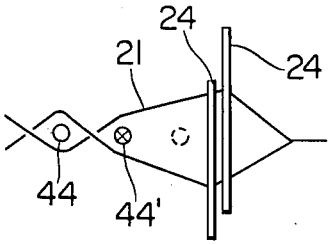
Figure 4F:
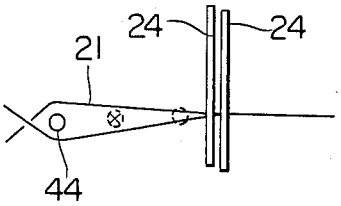
Figure 5F:
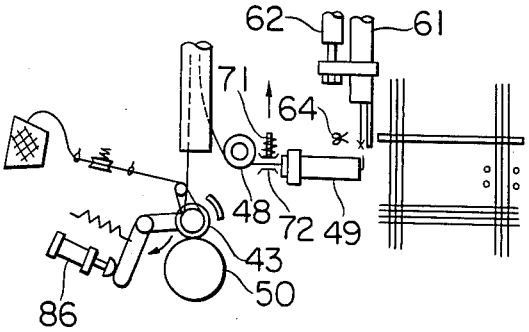

In this shed-forming position, the weft yarn 44' failing to get to the opposite selvage yarn is removed manually or by automatic operation. Then, the power is turned on (FIG. 5E) and the movable components of the loom are further reversed through approximately 270° and brought, as shown in FIG. 4F, to the shed-closing position (corresponding to the crank angle of about 270°). This position corresponding to the crank angle of approximately 270° is most suitable for restarting the air jet loom. The operating position of the movable loom parts corresponding to the crank angle of 270° is slightly in arrear of the position that existed during the dwell time initiated by the failure signal, or the position corresponding to the crank angle of 300° as described above. In this manner, the length of yarn supplied upon restarting is slightly longer than that supplied during steady-state operation. Thus, the weft can be inserted positively for assuring smooth restarting of the loom operation.

Figure 4G:
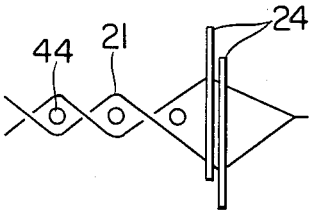
Figure 5G:
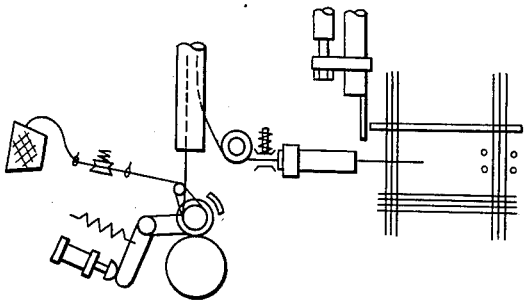

In this state, the loom is readied for restarting automatically. Thus, the end of the weft yarn sucked into the nozzle 61 is cut by the second weft yarn cutter 64 mounted on the tip of the suction nozzle 61. The main air jet nozzle 49 is rendered operative and the magnetic solenoid 71 is deenergized for opening the auxiliary gripper 72. The main gripper 48 is also set to a normal operating state. The piston of the air cylinder 86 is retracted for biasing the feed roller 43 against the periphery of the drum 50 for activating the weft supply unit. In this state, the operation of the air jet loom is restarted (FIGS. 4G and 5G).

From the foregoing it is seen that, according to the present invention, upon detection of the weft inserting failure, the operation of weft yarn insertion ceases and the movable parts are brought to a stop after passing through the state of inertial operation. After the movable parts are stopped completely, the driving motor is reversed so that the various moving parts of the device are returned to a state such that the weft yarn previously laid down and which has failed to reach the opposite selvage yarn may be removed by manual operation. In this manner, only the yarn failing to get to the opposite selvage yarn need be removed, which means that the operation is facilitated and accelerated and that the movable parts can be restarted only after a relatively short dwell time and without substantially lowering the operating efficiency of the jet loom through weft inserting failure.

Since it is necessary to remove only the weft yarn failing to reach the opposite selvage yarn, the process of disposal of the weft yarn can be automated more easily than in cases where at least two weft yarns, that is, the yarn failing to reach the opposite fabric edge and one or more weft yarns inserted in the subsequent weaving cycle or cycles, need be removed severally, as in the conventional device.

In the above embodiments, the process of deflecting the weft yarn from its normal route by means of a suction nozzle to inhibit its insertion and stopping the reeling out of weft yarn during the reversal of operation of the movable loom parts can be implemented by a simplified mechanical system.

Figure 6A:
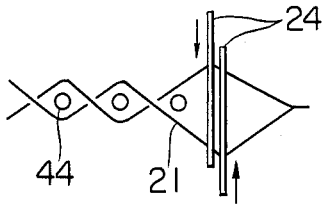
FIGS. 6A through 6I are schematic side views showing the various positions of heald frames and the shed in connection with the second embodiment of the invention.
Figure 6B:
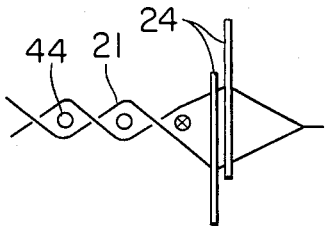
Figure 6C:
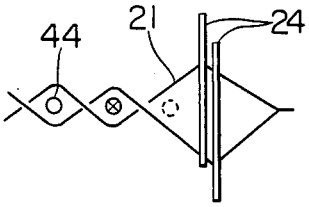
Figure 6D:
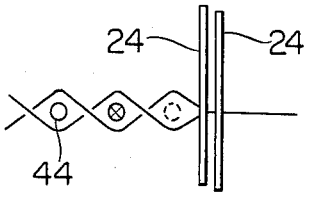
Figure 6E:
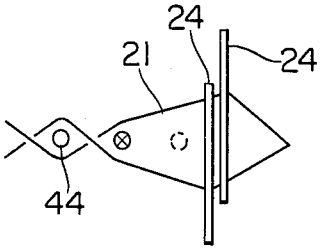
Figure 6F:
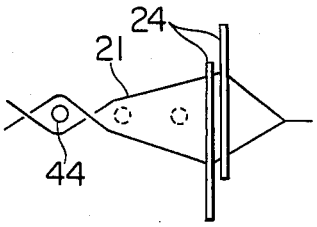
Figure 7F:
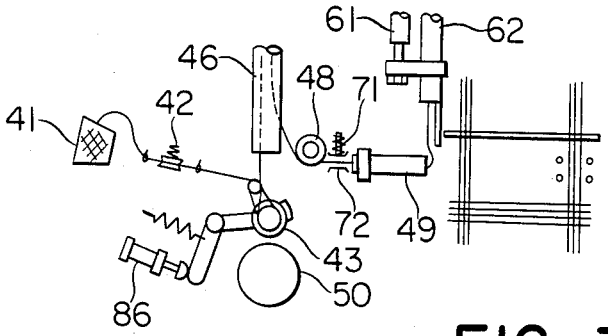
Figure 6G:
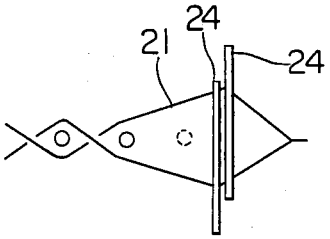
Figure 7G:
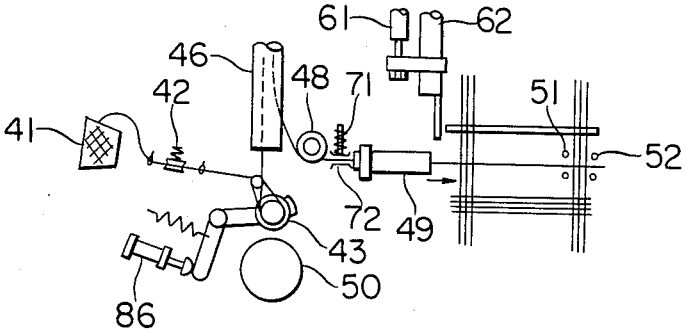
Figure 7H:
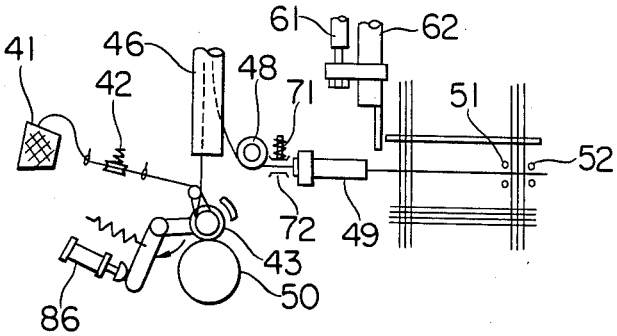

According to a modified embodiment shown in FIGS. 5, 6A through 6I and 7A through 7I, the process of weft insertion is discontinued transiently upon delivery of the weft inserting failure signal, and the movable components of the device are braked and stopped transiently. These components are then driven in reversa dn brought to a position allowing to removal of the yarn failing to reach the opposite fabric edge, as in the preceding embodiment. According to the present embodiment, after removal of the weft yarn failing to arrive at the opposite fabric edge, and before restarting the movable components in the normal direction, the one-pick length of the weft yarn which has been sucked into the suction nozzle and thus deflected from its normal course is inserted (oneshot weft yarn insertion). Thus, the steps shown in FIGS. 6A through 6E and FIGS. 7A through 7E are the same as those shown in FIGS. 4A through 4E and 5A through 5E. After removing the weft yarn failing to arrive at the opposite selvage the magnetic solenoid 71 is kept energized, so that the auxiliary gripper 72 remains closed, while similarly the gripper 48 is maintained in the closed state (FIGS. 6F and 7F). In this state, the operational timing of the main air jet nozzle 49 and the auxiliary nozzle is controlled by a solenoid valve, not shown, so that the one pick length of the weft yarn stored in the suction nozzle 61 is inserted at a reduced speed into the warp shed and at a timing different from one prevailing during normal operation (FIGS. 6G and 7G). It should be noted that the auxiliary nozzle may be formed integrally with or separately from the weft guide, as desired.

Figure 6H:
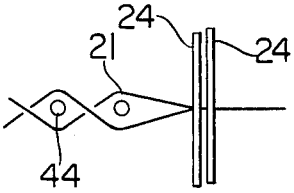
Figure 6I:
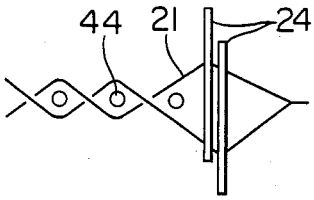
Figure 7I:
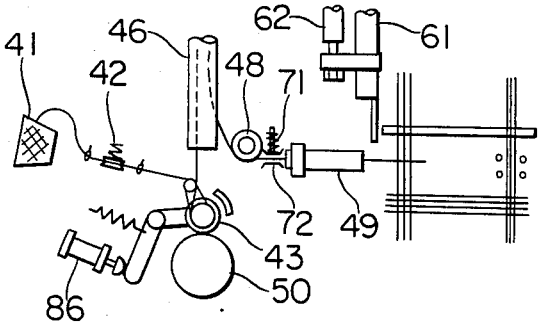

In this state, the device is readied for restarting automatically. Thus, the magnetic solenoid 71 is deenergized to open the auxiliary gripper 72. Simultaneously, the gripper 48 is brought to its normal operating state. The piston of the air cylinder 86 is retracted for biasing the feed roller 43 against the peripheral surface of the drum 50 for activating the weft yarn supply or reeling out unit. In this state, the operation of the air jet loom is restarted (FIGS. 6I and 7I).

In the preceding first embodiment, since the removal of the weft yarn failing to reach the opposite selvage is not followed directly by the insertion of the weft yarn length stored in the suction cylinder, the movable components are driven further in reverse and brought to the restartable position. In the present embodiment, since the removal of the weft yarn failing to reach the opposite selvage is followed directly by the one-shot weft insertion, the movable components are not driven in the reverse direction but in the normal direction (by approximately 90°) and halted transiently at a crank angle position of approximately 270°. At this time, the movable components including the gripper 48 and the friction roller 43 are brought to a restartable position shown in FIG. 6H. These components are then restarted automatically to initiate the steady-state operation (FIGS. 6I and 7I).

In the present embodiment, since the weft yarn is inserted before the start of normal operation and, upon restarting, the weft yarn end is cut by the cutter 55 operating at the timing of the normal operation, a proper length of the weft yarn is extended for each weaving cycle from the main air jet nozzle 49 upon restarting, thus reducing the chance of restarting troubles.

In the aforementioned second embodiment, the weft yarn inserted at the time of one-shot weft insertion is the length of the weft yarn sucked and stored in the suction nozzle. Alternatively, the weft yarn following the yarn failing to reach the opposite selvage may be sucked in its entirety into the suction nozzle, and a length of the weft yarn measured out at and supplied from the weft yarn length measuring unit may be used for one shot insertion. In this case, an auxiliary electric motor is connected via an electromagnetic clutch, for instance, to the weft yarn length measuring unit, which unit may be operated independently of the other movable components of the loom during measurement of the weft yarn destined for one-shot weft insertion and thus in a manner different from the steady-state operation.

Figure 7:
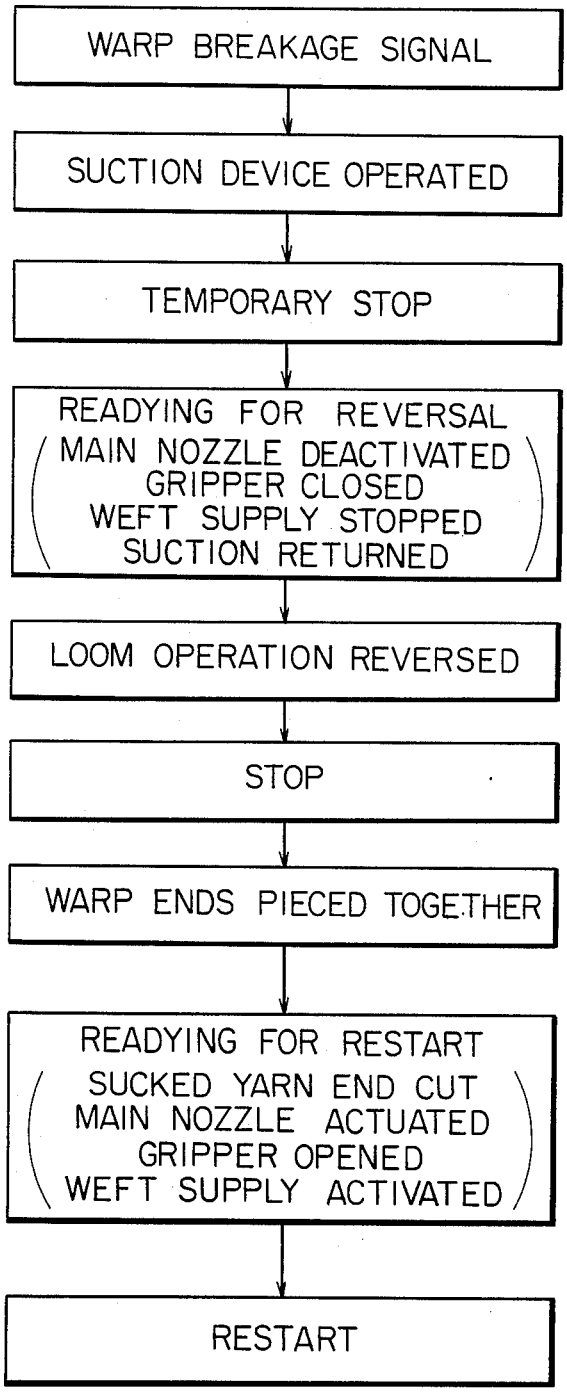
FIG. 7 is a flowchart for the third embodiment of the method according to the present invention.

In the foregoing, the case of disposing of the weft yarn failing to reach the opposite selvage has been described. However, the present invention may be applied to the cases of breakage of weft or selvage yarns or standstill of the loom caused by human intervention. An example of this application is shown in FIG. 7. In this case, the steps up to the step of readying for reversal of operation are same as those of the first embodiment shown in FIG. 3. The movable components are operated in reverse through approximately 390° in terms of the crank angle and thus brought to the shed-closing position immediately preceding the weft insertion inhibit state (i.e. up to the position corresponding to the crank angle of approximately 270°). In this state, the broken ends of the warp yarn are joined to each other. The power is then turned on. The process of readying for restarting and the process of restarting are then carried out as in the first embodiment. It should be noted that, in the state of readying for reversal of operation, the warp yarns are substantially in the shed-closing position, and hence the operation of joining the warp threads together may be carried out without reversing the operation of the moving components. After the warp yarn ends are joined to each other, the operation of the movable parts is reversed so that the components are brought to the shed-closing position that existed immediately before occurrence of the weft yarn insertion inhibit state. Thereafter, the movable loom parts are ready for restarting and are restarted for weaving operation.

In cases where the one-shot weft insertion is to be effected at the time of piecing the broken warp yarn, the loom operation is reversed for setting the loom to the shed-closing position preceding the insertion inhibit state (crank angle of about 270°). The broken ends of the warp yarn are pieced together in this state. The movable loom parts are then operated in the normal direction through approximately 270° in terms of the crank angle and brought to the shed-forming state in which the weft yarn inhibited from entering the shed ought to have been inserted into the shed. The following procedure is the same as the one-shot weft insertion for the embodiment shown in FIG. 5. When the warp yarn ends are pieced together prior to reversal, the loom operation is reversed through approximately 120° after piecing together the warp yarn ends. In this manner, the loom is set to the shed-forming state in which the inhibited weft ought to have been inserted. The following procedure is the same as the one-shot weft inserting procedure described in connection with FIG. 2.

Figure 8:
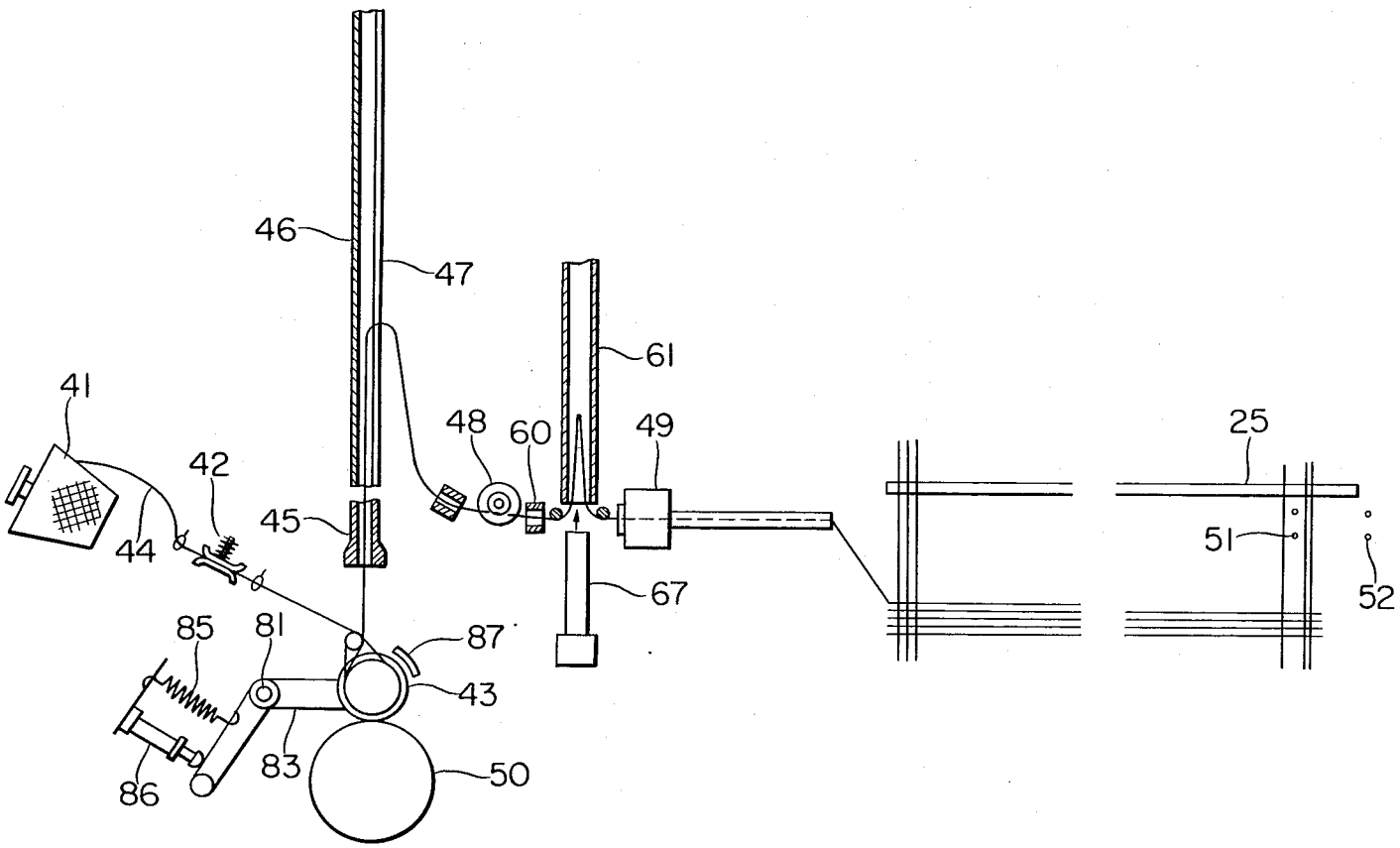
FIG. 8 is a schematic plan view showing a modified embodiment of the weft yarn disposal device of the invention.

In the weft inserting device shown in FIG. 2, the main nozzle 61 is provided between the suction nozzle 49 and the selvage yarn. However, this suction nozzle may also be provided between the weft yarn supply unit and the jet nozzle. Referring to FIG. 8, the suction nozzle 61 is provided between the gripper 48 and the main nozzle 49 and has its tip in the neighborhood of the weft route. An air nozzle 67 is provided opposite to the suction nozzle 61 for causing the weft yarn to be deflected away from its route and into the inside of the suction nozzle 61. In the drawing, the numeral 60 designates a weft yarn guide.

The operation of the embodiment shown in FIG. 8 will be described below in connection with FIGS. 1 and 5.

When the failure in the weft yarn insertion has occurred, inserting failure signals are transmitted from the sensors 51, 52, as in the embodiment shown in FIG. 2. By these signals, the motor 11 (FIG. 1) driving the various movable parts of the loom is halted and enters into an inertial operation. The weft yarn cutter 55 provided at the exit of the main air jet nozzle 49 is rendered inoperative, and the weft now connects continually from the main air jet air nozzle 49 to the shed along the normal weft route.

When the weft inserting failure signals are issued, compressed air is ejected from the air nozzle 67 towards the weft yarn disposed on the weft route. In this manner, the weft yarn impelled from the main air jet nozzle 49 after the occurrence of inserting failure is entrained in the compressed air stream from the air nozzle 67 and gets to the suction nozzle inlet where it is sucked into the inside of the nozzle without being directed towards the shed. Preferably the supply of compressed air to the main air jet nozzle 49 is discontinued upon delivery of the inserting failure signals for elevating the capacity of weft suction of the suction nozzle 61.

Figure 5:
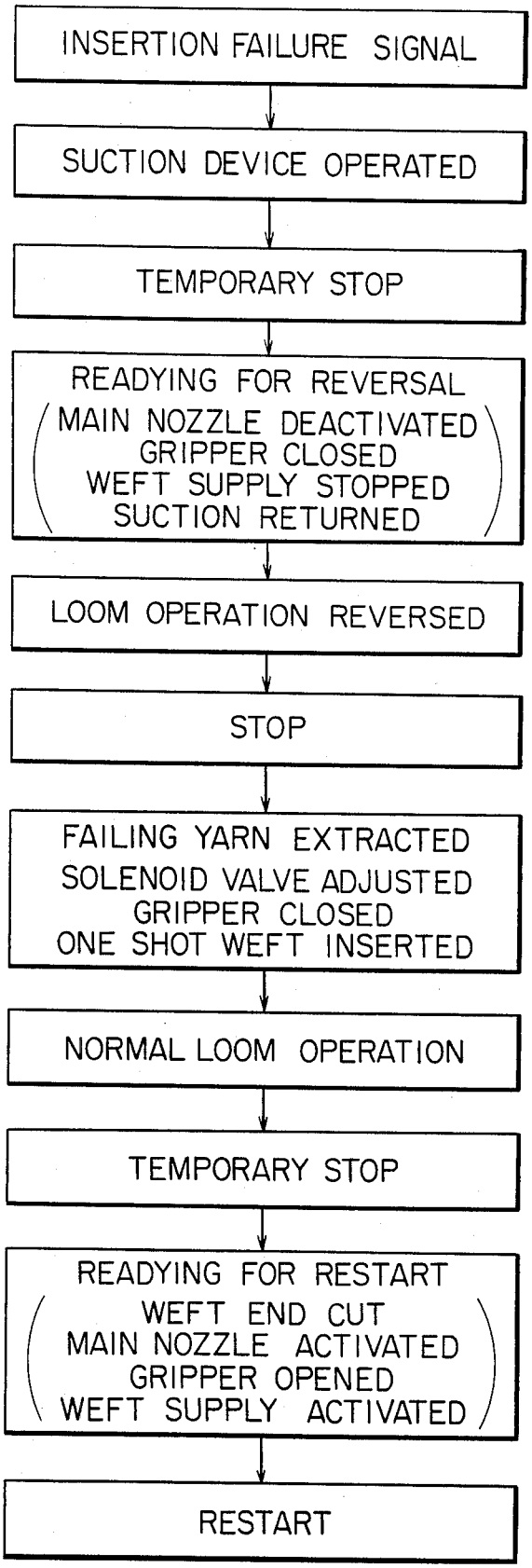
FIG. 5 is a flowchart for the second embodiment of the method according to the present invention.
Figure 7A:
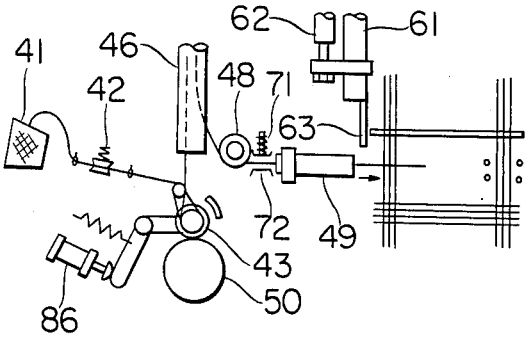
FIGS. 7A through 7I are schematic views of the weft inserting device corresponding to FIGS. 6A through 6I, respectively.
Figure 7B:
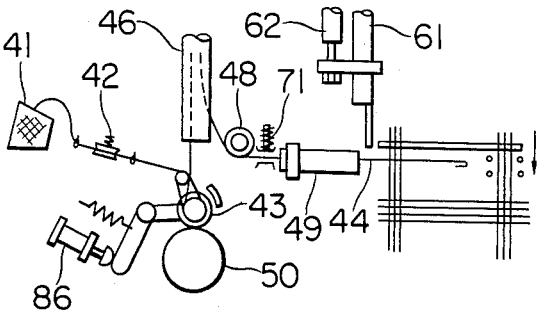
Figure 7C:
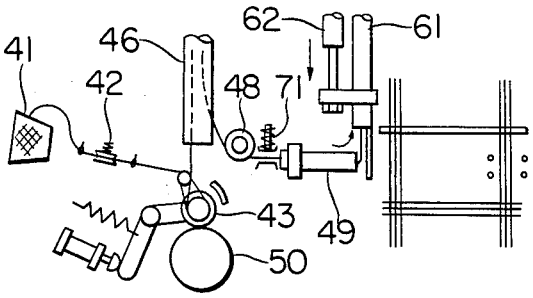
Figure 7D:
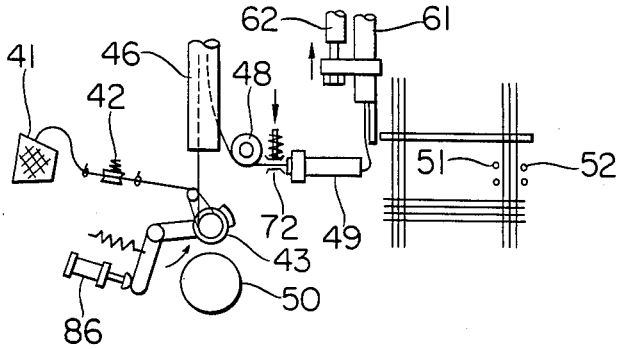
Figure 7E:
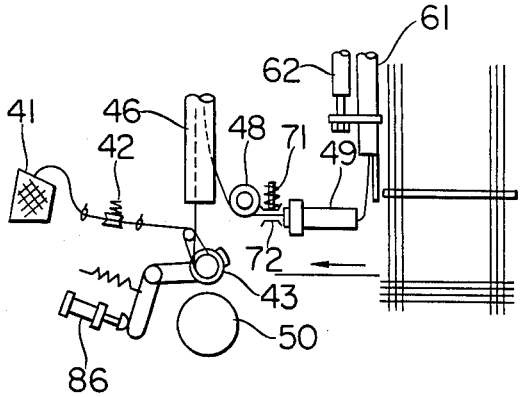

The operating procedure up to the step of standstill of the movable parts through the steps of temporary standstill or dwell, readying for reversal and reversal is the same as that shown in FIG. 5. Thus the various movable parts of the loom are driven in reverse through approximately 480° and stopped at the shed-forming position of the warp yarns 21 corresponding to the crank angle of approximately 180°.

In this shed-forming state, the weft yarn 44 failing to reach the opposite edge of the fabric extends continually from the main air jet nozzle to the shed. This weft yarn is removed manually and the weft yarn end is cut at the position of the tip of the main air jet nozzle 49. With the gripper 48 kept closed, the power is turned on. In this state, the operational timing of the main air jet nozzle 49 and the auxiliary nozzle is controlled by a solenoid valve, not shown, so that a one-pick length of the weft yarn stored in the suction nozzle 61 is inserted at a reduced speed into he shed (one-shot weft insertion) at a different timing from one employed during normal operation. The auxiliary nozzle may be provided integrally with or separately from the weft yarn guide, as desired. After the one-shot weft insertion, the movable parts of the loom are driven in normal direction through approximately 90° and thus brought to the shed-closing position of the warp yarns 21 suitable for loom restarting (corresponding to the crank angle of approximately 270°).

It should be noted that the weft yarn 44 disposed within the suction nozzle 61 may be withdrawn and cut off from the side of the main air jet nozzle 49 at the same time that the weft yarn failing to reach the opposite edge of the fabric is removed. In this manner, the one shot weft insertion may be dispensed with.

It should be noted that, when the movable loom parts are returned to the 180° crank angle position through reversal of the operation as described hereinabove, the weft yarn 44 connecting continually from the main air jet nozzle 49 to the shed may be removed automatically by any suitable mechanical means, and the power is then turned on automatically. Since the weft yarn failing to reach the opposite selvage connects continually towards the supply unit from the main air jet nozzle 49, it can be held easily at the tip of the main air jet nozzle 49 and removed. Since the weft yarn route from the jet nozzle to the shed is substantially the same during abnormal operation as during normal operation, the yarn failing to reach the opposite edge of the fabric may be sensed easily and automatically (by mechanical means) to provide for reliable removal of the broken yarn. In this manner, the operation is promoted and facilitated and the loom can be restarted after only a relatively short dwell time without appreciably lowering the operating efficiency of the jet loom through the weft inserting failure as described hereinabove.

Figure 9:
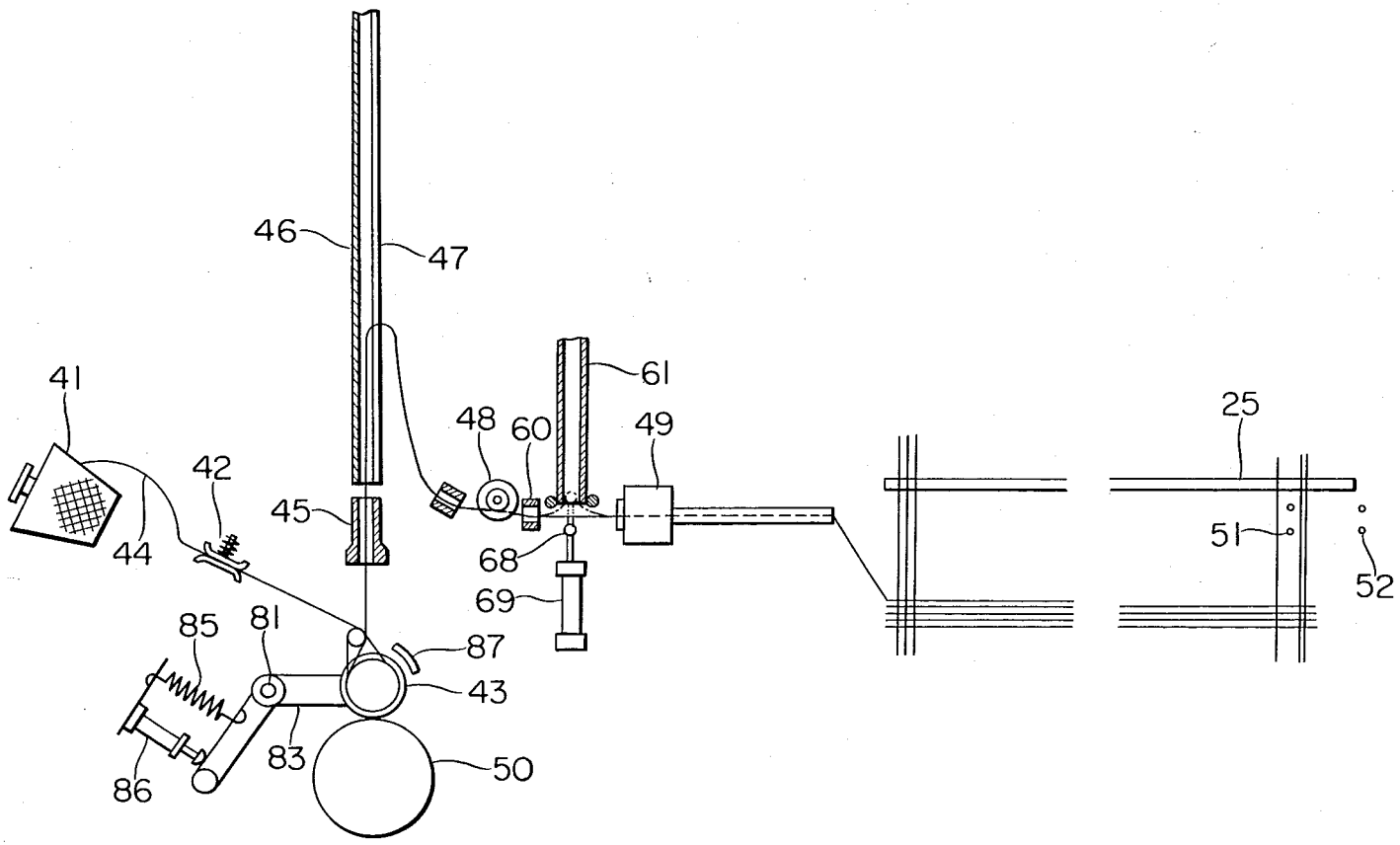
FIGS. 9 and 10 are schematic plan views showing modifications of the device shown in FIG. 8.

In the second embodiment of the weft inserting device, shown in FIG. 8, the air nozzle 67 is provided opposite to the suction nozzle 61 for entraining weft yarn in the compressed air supplied from the air nozzle 67 for forcing the weft yarn into the inside of the suction nozzle 61. In a modification shown in FIG. 9, a presser 68 is disposed in opposition to the suction nozzle 61 and mounted to the foremost part of a reciprocating member such as the piston of the air cylinder 69 or an armature of an electromagnetic solenoid, not shown. The presser 68 is movable from a first position offset from the weft route at the side opposite from the suction nozzle 61 to a second position beyond the weft route and close to the suction nozzle and vice versa so that the weft may be urged towards and sucked more easily into the inside of the nozzle when the presser 68 is moved from said first position towards said second position.

Figure 10:
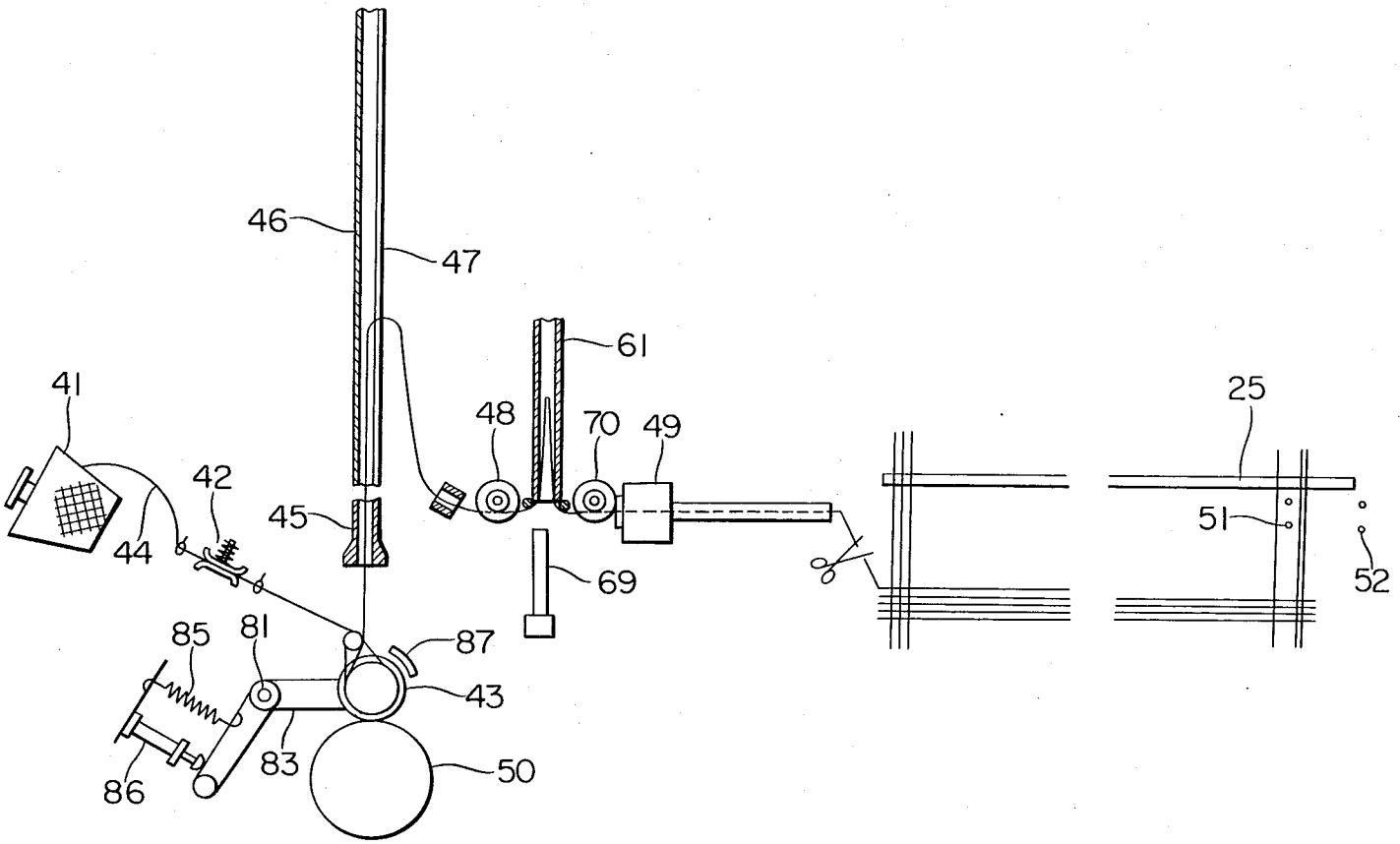
Figure 11:
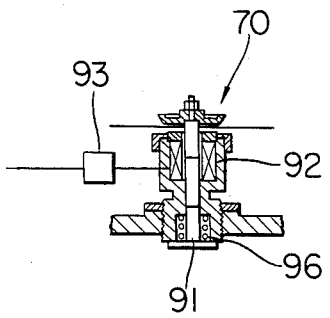
FIGS. 11 and 12 are cross-sectional views showing different auxiliary grippers used in the device of FIG. 10.
Figure 12:
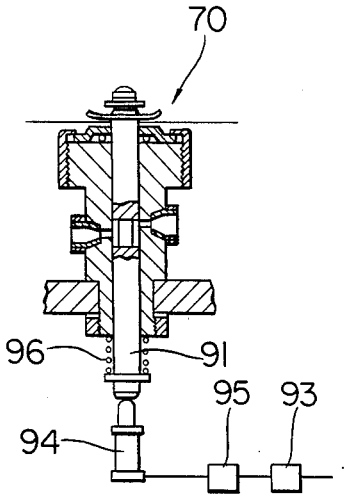

In the above embodiments, responsive to stop signals, the weft cutting device 55 is rendered inoperative so that the weft yarn is not cut but extended continually through the main air jet nozzle 49 to the warp shed. However, the weft yarn may also be cut at the position of the tip of the main air jet nozzle 49 after stop signal delivery and prior to removal of the weft yarn failing to reach the opposite edge. In this case, as shown in FIG. 10, an auxiliary gripper 70 is preferably mounted between the suction nozzle 61 and the main air jet nozzle 49 and operable independently of the crankshaft to grip the weft yarn upon delivery of the stop signals. As shown in FIG. 11, an auxiliary gripper 70 of the present invention is formed as a vertically movable rod 91 in the form of an armature of an electromagnetic solenoid 92 that is energized or deenergized through operation of a controller 93. Alternatively, as shown in FIG. 12, the end part of the vertically movable rod 91 is acted on by the end of a vertically movable member such as a piston of a pneumatic cylinder or an armature of an electromagnetic solenoid, not shown. A changeover valve 95 is connected to the reciprocating member 94 and controlled by controller 93. The numeral 96 designates a spring for pressing down the rod 91.

Figures 13, 14:
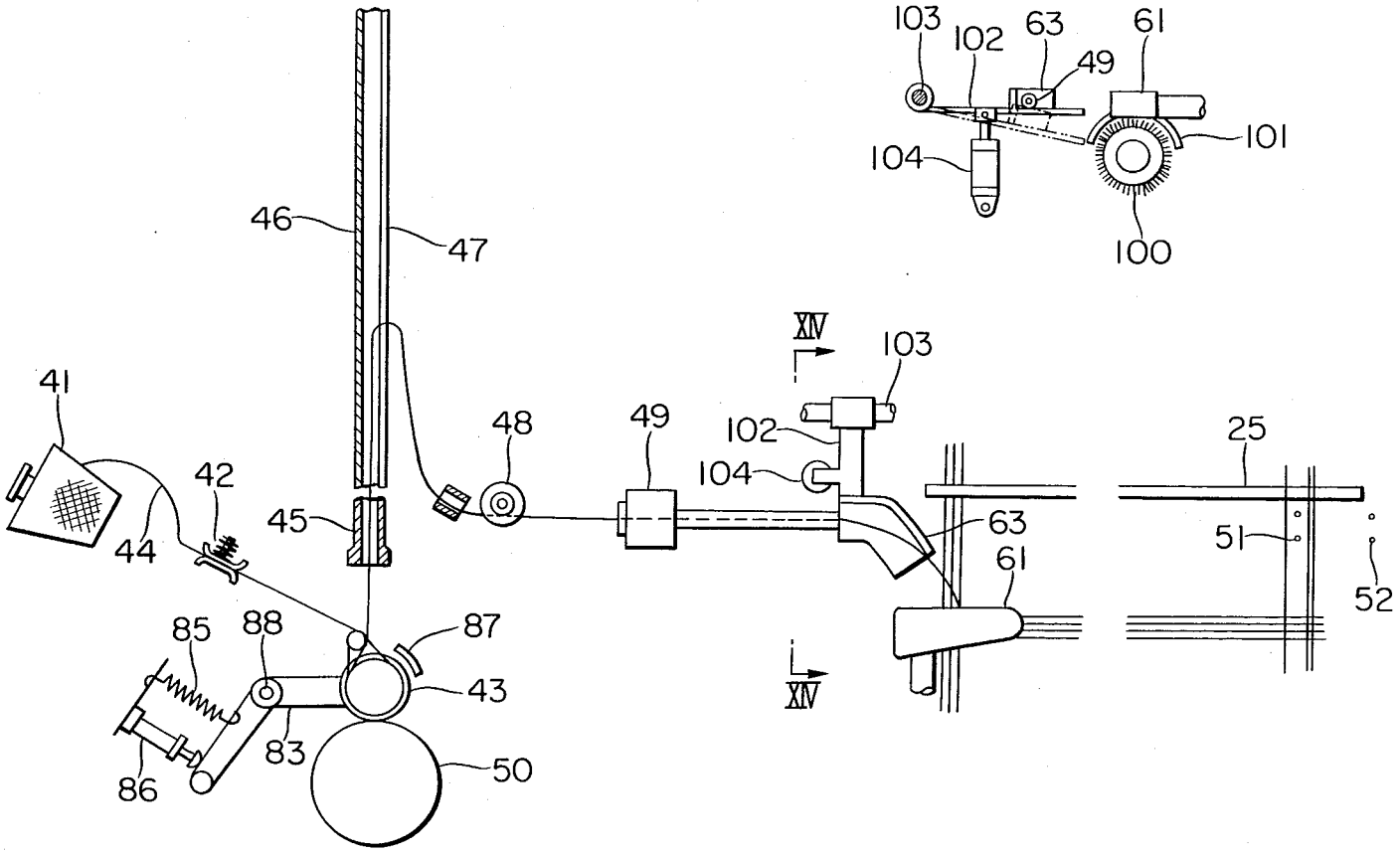
FIG. 13 is a schematic plan view showing a further embodiment of the disposal device of the invention.
FIG. 14 is a sectional view taken along the line XIV—XIV of FIG. 13.

FIG. 13 shows a further embodiment of the weft yarn disposal device of the present invention. It is conventional practice in a loom to make use of temples for stretching the edge parts of the fabric transversely in the neighborhood of the cloth fell in order to prevent widthwise cloth shrinkage. According to the present invention, an ejector type suction nozzle 61 as known per se and operable to produce a force of suction under the effect of compressed air is provided close to and for example above one of such temples, as for example a ring temple 100 mounted on the side of the cloth towards the main air jet nozzle 49. The suction nozzle 61 is attached to a cover 101 mounted above the ring temple 100. An arcuate guide plate 63 is mounted between suction parts of the main air jet nozzle 49 and the suction nozzle 61. The guide plate 63 has an upright wall on the side opposite to the suction nozzle 61. When positioned as shown in FIG. 13, the plate 63 is operable so that the weft yarn ejected from the nozzle 49 is guided towards the suction nozzle 61. The guide plate 63 is attached to a lever 102 and rotatable within a substantially vertical plane about shaft 103. The lever 102 is operatively connected with a reciprocating unit 104 such as a pnuematic cylinder or electromagnetic solenoid in such a manner that, when the unit 104 is lowered, the guide plate 63 is moved to a position offset from the route of the warp yarn impelled from the main air jet nozzle 49 and, when the unit 104 is elevated, the guide plate 63 is moved to a position adjacent to the route of the weft yarn.

Figure 15:
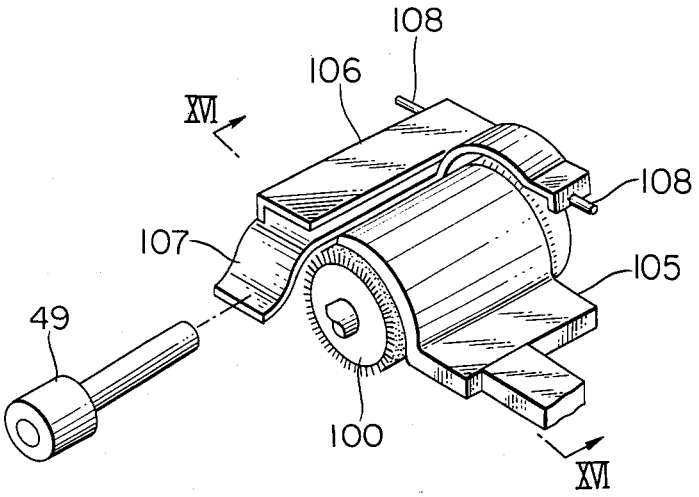
FIG. 15 is a perspective view showing a modification of the weft disposal device shown in FIG. 14.
Figure 16:
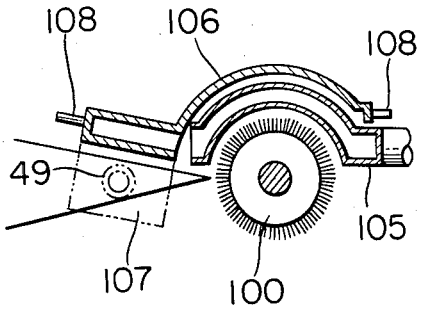
FIG. 16 is a side view looking in the direction of the line XVI—XVI of FIG. 15, shown partly in section.

Alternatively, the cover 101 on top of the ring temple 100 may be replaced by a suction nozzle 105 having an arcuate cross section as shown in FIGS. 15 and 16. The suction nozzle 105 plays the part of both the cover 101 and the nozzle 61 of the embodiment shown in FIGS. 13 and 14. The guide plate 106 has a U-shaped cross section opened towards the suction port of the nozzle 105 and has a guide surface 107 towards the main air jet nozzle 49. The guide plate 106 is also pivotally mounted about shaft 108 so that the guide surface 107 is movable between a position to intersect the weft yarn route extending from the main air jet nozzle 49 and a position offset from the weft route.

In the above embodiments, the suction nozzles 61 and 105 are provided close to the ring temple 100. However, the present invention is not limited to the ring temple and the suction nozzles may also be provided in the vicinity of other types of temples such as roller temples or stay temples.

The operation of the embodiments shown in FIGS. 13 through 16 will be described in connection with FIGS. 1 and 5.

Similarly to the embodiment of FIG. 2, upon the occurrence of the failure in the weft inserting operation, inserting failure signals are issued from the sensors 51, 52. Responsive to these signals, the driving operation of motor 11 (FIG. 11) driving the movable loom parts ceases and the motor 11 enters into an inertial operation.

On the other hand, responsive to the inserting failure signal, the piston of the reciprocating unit 104 is raised so that the guide plates 63, 106 are placed across the weft route at the exit side of the main air jet nozzle 49. Thus, the weft yarn ejected from the main air jet nozzle 49 next to the inserting failure is guided by the guide plates 63, 106 and gets to the suction nozzles 61, 105 to be sucked into these nozzles. In this manner, the insertion of the weft yarn into the shed may be prevented positively.

The operating procedure up to the step of standstill of the movable parts through the steps of temporary stop or dwell, readying for reversal and reversal of operation is the same as that shown in FIG. 5. Thus the various parts of the loom are driven in reverse through approximately 480° and halted at the shed-forming position of the warp yarns 21 (corresponding to the crank angle of about 180°).

In this shed-forming position of the warp yarns, the weft yarn 44 failing to reach the opposite selvage is removed manually or automatically, after which the power is turned on. Thus, the movable loom parts are driven in reverse through approximately 270° and brought to a shed-closing position corresponding to the crank angle of approximately 270°. This position is suitable as the starting position for the air jet loom.

In this state, the device is automatically readied for starting. Thus, the main air jet nozzle 49 is rendered operative. The gripper 48 is also set to its normal operating state. The piston of the pneumatic cylinder 86 is retracted for pressuring the feed roller 43 against the peripheral surface of the drum 50, so that the weft yarn supply unit is also rendered operative. In this state, the operation of the air jet loom is restarted. Hence, after restarting, the weft yarn is cut by a weft yarn cutter, not shown, provided close to the temple, as during its steady-state operation.

In the above embodiments, the guide plate is rotated for guiding the weft yarn therealong towards the suction nozzle. It is however possible to eliminate these guide plates, in which case the weft yarn end projecting from the main air jet nozzle after disposal of the failing weft yarn is guided manually towards the suction nozzle.

It is seen that, according to the present embodiment, since the suction nozzle is positioned close to the temple situated in turn in the neighborhood of the weft yarn route, it is possible to cut the end of the weft yarn sucked into the nozzle with the use of ordinary weft yarn cutters. Thus, upon cutting the weft yarn sucked into the suction nozzle, the weft yarn is projected from the main air jet nozzle by a proper length as during the steady-state weft inserting operation, thus assuring a positive weft inserting operation after starting and eliminating inserting troubles. In addition, when the device is applied to inhibiting the weft insertion during inertial operation of the braked device, the separate cutter for cutting the weft yarn projecting from the main air jet nozzle may be dispensed with. Since only one cutter is now required for cutting the weft yarn, the cutter control system may be simplified thus resulting in lowered investment costs.

Figure 17:
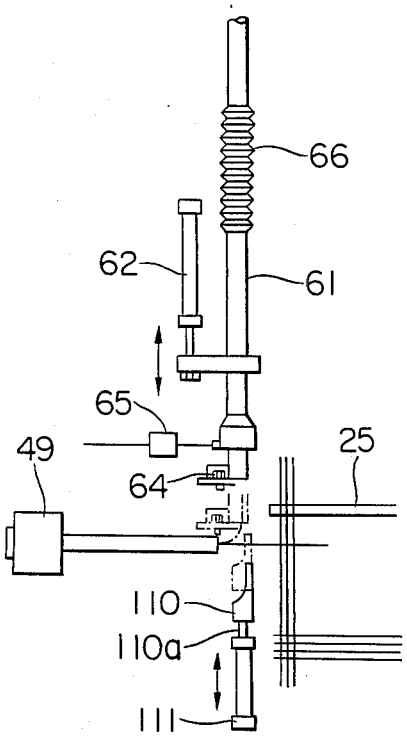
FIG. 17 is a schematic plan view showing a further modification of the weft yarn disposal device of the invention.
Figure 18:
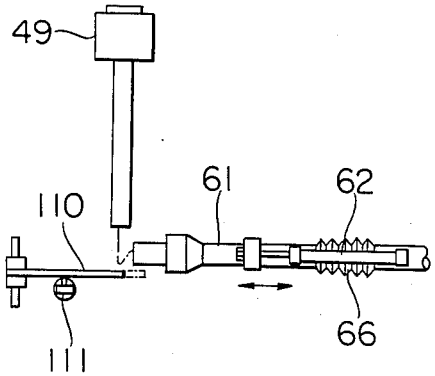
FIG. 18 is a schematic plan view showing a modification of the device shown in FIG. 17.
Figure 19:
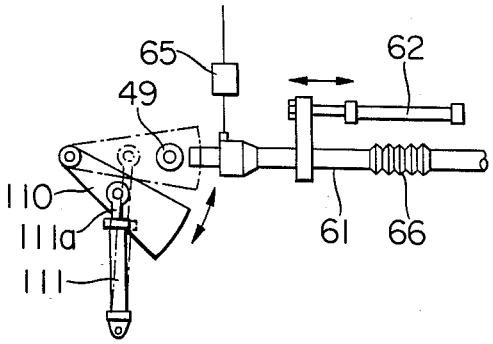
FIG. 19 is a front view of FIG. 18.

FIGS. 17 through 20 show a further modification of the weft yarn disposal system of the present invention. In the embodiment shown in FIG. 2, the guide plate 63 is fastened to the tip of the suction nozzle 61 for movement conjointly with the nozzle 61. However, as shown in FIGS. 17 through 19, it is also possible to provide the guide plate 110 separately from the suction nozzle 61 to reduce the weight and increase the mobility of the suction nozzle 61. In the embodiment shown in FIG. 17, a guide plate 110 is fastened to the end of a piston 111a of a pneumatic cylinder 111 provided at the side of the weft route opposite to the suction nozzle 61. When the piston 110a of the pneumatic cylinder 111 is advanced, the guide plate 110 intersects the weft yarn route for directing the weft ejected from the nozzle 49 towards the suction nozzle 61, as indicated by the chain-dotted line, the suction nozzle 61 then sucking the weft and interfering with weft insertion. When the piston 111a of the pneumatic cylinder 111 is allowed to regress, the guide plate 110 is moved away from the weft route to permit the weft to be inserted into the shed without obstructions presented by the guide plate 110. It should be noted that, instead of being fixed, the suction nozzle 61 may also be reciprocated by a pneumatic cylinder 62 or the like reciprocable unit or rotated by means not shown. The suction nozzle 61 may then be advanced to close to the weft route for more positive suction of the weft yarn and retracted sufficiently from the waft route to eliminate the possibility of interfering with weft yarn insertion.

In a modification shown in FIGS. 18 and 19, the guide plate 110 is mounted for rotation about an unnumbered pin and the piston 111*a* of the pneumatic cylinder 111 is coupled to the guide plate 110. The piston 111a of the pneumatic cylinder 111 may be raised or lowered for rotating the guide plate 110 in one or the other direction.

Figure 20:
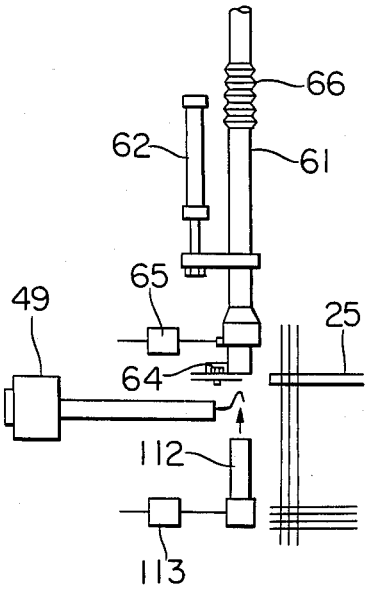
FIG. 20 is a schematic plan view showing another modification of the device of FIG. 17.

In the above embodiments, the guide plate is rigid and mounted for movement between a position to intersect the weft route and a position offset from said route. In a modification shown in FIG. 20, a jet nozzle 112 for ejecting compressed air is used as guide means in place of the aforementioned guide plate. Referring to FIG. 20, the nozzle 112 is mounted opposite to the suction nozzle 61 with the weft route therebetween and in axial alignment with the suction nozzle. By the operation of a changeover valve 113, compressed air is ejected from the nozzle 112 and the weft yarn entrained in the compressed air is carried towards the suction nozzle 61 into which it is introduced positively under suction. In this manner, weft insertion is prevented from occurring.

What is claimed is:

1. A method for disposal of weft yarns in a jet loom in which measured lengths of the weft yarns from a weft yarn supply unit are inserted into a warp shed under the effect of a fluid ejected from a jet nozzle which is maintained at all times in fixed position for inserting yarn into said warp shed, wherein the loom is braked when stop signals for the loom are sensed, and the weft yarn is inhibited from proceeding into said warp shed until the braked loom is halted, at which time the loom operation is reversed to change the opening of said warp shed for correction of the condition which initiated said stop signals, said weft yarn being inhibited from proceeding into the warp shed when said stop signals are sensed by being deflected from its usual route when the yarn is about to enter said shed by guide means actuated by said stop signals and which deflect and guide the weft yarn toward a suction nozzle having a suction opening facing in the direction of the route of the weft yarn during normal operation, to be sucked away from the warp shed by said suction nozzle, whereupon said sucked yarn is cut at a location along its deflected route between said suction nozzle and said jet nozzle.

2. The method as claimed in claim 1, characterized in that said stop signals are failure signals indicating the failure in weft insertion and the loom operation is reversed for setting the loom to a shed-forming position of the warp yarns allowing extraction of the weft yarn inserted at the time of said failure signals.

3. The method as claimed in claim 1, characterized in that said stop signals are signals produced due to warp breakage and the loom operation is reversed for setting the loom to a shed closing position of the warp yarns prevailing immediately before occurence of the weft insertion inhibited state.

4. A device for disposal of weft yarns in a jet loom in which measured lengths of the weft yarn from a weft yarn supply unit are inserted into a warp shed under the effect of a fluid ejected from a jet nozzle which is maintained at all times in a fixed position for inserting yarn into said warp shed, and each said measured length is cut from said supply by a first weft yarn cutter maintained in fixed position between said nozzle and said warp shed, said device comprising means for generating stop signals for stopping the loom operation, means responsive to said stop signals for braking the loom, and means for reversing the loom operation after braking, and wherein there is provided a suction nozzle positioned in the neighborhood of the weft yarn route intermediate said jet nozzle and said warp shed and having a suction opening facing in the direction of the weft yarn route during normal operation, guide means for deflecting the weft yarn toward said suction nozzle so that the weft yarn is sucked througn the suction opening of said suction nozzle upon generation of said stop signals, and a second yarn cutter located along the deflected route of said weft yarn between said jet nozzle and said suction opening for cutting said sucked weft yarn from said yarn supply.

5. The device as claimed in claim 4, characterized in that the suction nozzle is mounted in the neighborhood of a jet loom temple.

6. The device as claimed in claim 4, characterized in that said guide means comprises a guide plate mounted at a position opposite to said suction nozzle and movable between a position away from the suction nozzle with said weft yarn route interposed between it and the suction nozzle and a position adjacent to the suction nozzle to intersect the weft yarn route for guiding the weft yarn towards said suction nozzle.

7. A device for disposal of weft yarns in a jet loom in which measured lengths of the weft yarn from a weft yarn supply unit are inserted into a warp shed under the effect of a fluid ejected from a jet nozzle which is maintained at all times in a position for inserting yarn into said warp shed, said device comprising means for generating stop signals for stopping the loom operation, means responsive to said stop signals for braking the loom, and means for reversing the loom operation after braking, and wherein there is provided a suction nozzle having a suction opening facing in the direction of the weft yarn route during normal operation, and guide means for deflecting the weft yarn toward said suction nozzle so that the weft yarn is sucked through the suction opening of said suction nozzle upon generation of said stop signals, said suction nozzle being mounted in the neighborhood of a jet loom temple, said temple being of the roller type and said suction nozzle being formed in a cover of said temple.

8. A device for disposal of weft yarns in a jet loom in which measured lengths of the weft yarn from a weft yarn supply unit are inserted into a warp shed under the effect of a fluid ejected from a jet nozzle which is maintained at all times in a position for inserting yarn into said warp shed, said device comprising means for generating stop signals for stopping the loom operation, means responsive to said stop signals for braking the loom, and means for reversing the loom operation after braking, and wherein there is provided a suction nozzle having a tip that can be positioned in the neighborhood of the weft route, and guide means for deflecting the weft yarn toward said suction nozzle so that the weft yarn is sucked through the tip of said suction nozzle upon generation of said stop signals, said suction nozzle being mounted so that its suction end tip is positioned close to the weft route intermediate the weft yarn supply unit and the jet nozzle.

9. The device as claimed in claim 4, characterized in that said guide means is a jet nozzle for compressed air disposed opposite to the suction nozzle so that the weft route is interposed between the guide means jet nozzle and the suction nozzle.

10. The device as claimed in claim 8, characterized in that an auxiliary gripper is provided between said suction nozzle and the jet nozzle and operable independently from a crankshaft of the loom.

11. A device for disposal of weft yarns in a jet loom in which measured lengths of the weft yarn from a weft yarn supply unit are inserted into a warp shed under the effect of a fluid ejected from a jet nozzle which is maintained at all times in a fixed position for inserting yarn into said warp shed, said device comprising means for generating stop signals for stopping the loom operation, means responsive to said stop signals for braking the loom, and means for reversing the loom operation after braking, and wherein there is provided a suction nozzle having a tip positioned in the neighborhood of the weft yarn route during normal loom operation, and guide means for deflecting the weft yarn toward said suction nozzle so that the weft yarn is sucked through the tip of said suction nozzle upon generation of said stop signals, said guide means having a guide plate movable between a position on the weft yarn route and a position offset from the route, said suction nozzle being mounted for advancement towards and retraction away from the weft yarn route and said guide plate being secured to said tip of the suction nozzle.

12. The device as claimed in claim 11, which further comprises a suction pipe connected to said suction nozzle to convey a flow of air for sucking the weft yarn, said suction pipe comprising a bellows-type expansion joint.

13. The device for disposal of weft yarns in a jet loom in which measured lengths of the weft yarn from a weft yarn supply unit are inserted into a warp shed under the effect of a fluid ejected from a jet nozzle which is maintained at all times in a position for inserting yarn into said warp shed, said device comprising means for generating stop signals for stopping the loom operation, means responsive to said stop signals for braking the loom, and means for reversing the loom operation after braking, and wherein there is provided a suction nozzle having a tip that can be positioned in the neighborhood of the weft route, and guide means for deflecting the weft yarn toward said suction nozzle so that the weft yarn is sucked through the tip of said suction nozzle upon generation of said stop signals, said suction nozzle tip being positioned in the neighborhood of the weft route intermediate a gripper and the jet nozzle.

* * * * *

UNITED STATES PATENT AND TRADEMARK OFFICE

CERTIFICATE OF CORRECTION

PATENT NO. : 4,620,570

DATED : November 4, 1986

INVENTOR(S) : H. SUZUKI

It is certified that error appears in the above-identified patent and that said Letters Patent is hereby corrected as shown below:

Column 1, line 39, after "failure", "is" should be --has--.

Column 1, line 41, first word "waft" should be --weft--.

Column 5, line 43, after "through", "5C" should be --5G--.

Column 6, line 28, after "into", "he" should be --the--; after "shed", "hsed" should be deleted.

Column 7, line 51, last two words "reversa dn" should be --reverse and--.

Column 7, line 52, after "allowing", "to" should be deleted.

Column 9, line 42, first word "main" should be --suction--; after "the", "suction" should be --main--.

Column 10, line 28, after "into", "he" should be --the--.

Column 11, line 62, after "a", "pnuematic" should be --pneumatic--.

Column 13, line 50, after "the", "waft" should be --weft--.

UNITED STATES PATENT AND TRADEMARK OFFICE

CERTIFICATE OF CORRECTION

PATENT NO. : 4,620,570

DATED : November 4, 1986

INVENTOR(S) : H. SUZUKI

It is certified that error appears in the above-identified patent and that said Letters Patent is hereby corrected as shown below:

Column 16, line 33, first word "The" should be --A--.

Signed and Sealed this

Twenty-fourth Day of March, 1987

*Attest:*

DONALD J. QUIGG

*Attesting Officer*

*Commissioner of Patents and Trademarks*